US006100783A

United States Patent [19]

Hopkinson et al.

[11] Patent Number: 6,100,783

[45] Date of Patent: Aug. 8, 2000

[54] ENERGY EFFICIENT HYBRID CORE

[75] Inventors: Philip J. Hopkinson, Charlotte, N.C.; Wesley W. Schwartz, Oshkosh, Wis.

[73] Assignee: Square D Company, Palatine, Ill.

[21] Appl. No.: 09/251,102

[22] Filed: Feb. 16, 1999

[51] Int. Cl.[7] ..... H01F 27/24

[52] U.S. Cl. ..... 336/216; 336/234; 336/218

[58] Field of Search ..... 336/234, 216–218, 336/212, 233

[56] References Cited

U.S. PATENT DOCUMENTS

| | | | |
|---|---|---|---|
| 3,775,722 | 11/1973 | Wentz et al. . | |
| 4,422,061 | 12/1983 | Yamamoto et al. | 336/218 |
| 4,521,954 | 6/1985 | Rademaker et al. . | |
| 4,668,931 | 5/1987 | Boenitz | 336/212 |
| 4,761,630 | 8/1988 | Grimes et al. . | |
| 5,073,766 | 12/1991 | Hays . | |
| 5,424,899 | 6/1995 | Scott et al. . | |
| 5,461,772 | 10/1995 | Puri . | |
| 5,515,597 | 5/1996 | Herbst et al. . | |
| 5,592,137 | 1/1997 | Levran et al. . | |

*Primary Examiner*—Michael L. Gellner
*Assistant Examiner*—Anh Mai
*Attorney, Agent, or Firm*—Michael J. Femal; Larry I. Golden

[57] ABSTRACT

A hybrid transformer core assembly having a first leg having a first end and a second end, a second leg having a first end and a second end, and opposing first and second yokes coupling the first and second legs to the first and second yokes to create a closed core. The first leg and second legs are made of a plurality of packets of laminations having a high grain orientation, and the first and second yokes are made of a plurality of packets of laminations having a lower grain orientation than the material of the first and second legs. Alternating laminations of the first and second legs are staggered to alternately extend beyond adjacent laminations of the respective leg at first and second ends thereof. A portion of the laminations of the first and second legs which extend beyond adjacent laminations of the first and second legs, respectively, overlaps portions of alternating laminations of the yokes and couples with notches of alternating laminations of the yokes. Additionally, a portion of the laminations of the first and second legs overlaps portions of alternating laminations of the yokes to similarly couples the legs with the yokes.

16 Claims, 2 Drawing Sheets

ENERGY EFFICIENT HYBRID CORE

DESCRIPTION

1. Technical Field

The present invention relates generally to transformers and, more particularly, to transformer cores and assemblies thereof.

2. Background of the Invention

Transformers are used extensively in electrical and electronic applications. Transformers are useful to step voltages up or down, to couple signal energy from one stage to another, and for impedance matching. Transformers are also useful for sensing current and powering electronic trip units for circuit interrupters such as circuit breakers and other electrical distribution devices. Other applications for transformers include magnetic circuits with solenoids and motor stators. Generally, the transformer is used to transfer electric energy from one circuit to another circuit using magnetic induction.

A transformer includes two or more multi-turned coils of wire placed in close proximity to cause a magnetic field of one coil to link to a magnetic field of the other coil. Most transformers have a primary winding and a secondary winding. By varying the number of turns contained in the primary winding with respect to the number of turns contained in the secondary winding, the voltage level of the transformer can be easily increased or decreased.

The magnetic field generated by the current in the primary coil or winding may be greatly concentrated by providing a core of magnetic material on which the primary and secondary coils are wound. This increases the inductance of the primary and secondary coils so that a smaller number of turns may be used. A closed core having a continuous magnetic path also ensures that practically all of the magnetic field established by the current in the primary coil will be induced in the secondary coil.

When an alternating voltage is applied to the primary winding, an alternating current flows, limited in value by the inductance of the winding. This magnetizing current produces an alternating magnetomotive force which creates an alternating magnetic flux. The flux is constrained within the magnetic core of the transformer and induces voltage in the linked secondary winding, which, if it is connected to an electrical load, produces an alternating current. This secondary load current then produces its own magnetomotive force and creates a further alternating flux which links back with the primary winding. A load current then flows in the primary winding of sufficient magnitude to balance the magnetomotive force produced by the secondary load current. Thus, the primary winding carries both magnetizing and load current, the secondary winding carries load current, and the magnetic core carries only the flux produced by the magnetizing current.

Even though transformers generally operate with a high efficiency, magnetic devices always have losses in the sense that some fraction of input energy will be converted to unwanted heat. The most obvious type of unwanted heat generation is ohmic heating in the windings resulting from the small, but inevitable winding resistance. Two other forms of losses occur in the core itself, due to hysteresis and eddy current losses.

Hysteresis loss represents the energy required to go around the hysteresis loop taking into account the cyclical time variation as the core alternately magnetizes and demagnetizes. Eddy current loss comes from the localized currents induced in the core by a time-varying flux which, in turn, causes ohmic heating. Eddy currents are currents induced in the magnetic core by the magnetic fields of the primary and secondary windings. If a solid core were used it would act as a shortened turn enclosing the flux path, thereby permitting a circulating current to flow and producing a very high eddy current loss. Accordingly, to minimize the energy lost due to these eddy currents, the magnetic core is formed by building it up from thin laminations stamped from sheet iron or steel. These laminations are, for the most part, insulated from each other by surface oxides and sometimes also by the application of varnish. The laminations reduce the magnitude of any circulating currents which will flow, thus reducing eddy current losses. Additionally, the steel used for the laminations of the entire core, i.e. the legs and the yokes, is usually a silicon-iron alloy which has been cold reduced to increase the degree of grain orientation within the laminations and give a lower hysteresis loss due to the smaller area of the hysteresis loop.

Generally, after forming the laminated core, the primary and secondary coils are placed over the laminated legs.

Unfortunately, standard transformer cores suffer from several drawbacks. Such drawbacks include inefficiency, large size, complex manufacturing and tooling requirements, and high cost. Additionally, the United States Department of Energy has been conducting investigations toward initiating higher standards regarding the minimum efficiency requirements for transformers.

Accordingly, a transformer core in accordance with the present invention provides an inexpensive and simple solution to eliminate the drawbacks of the prior transformer cores. The transformer core of the present invention also responds to potentially stricter Department of Energy standards.

SUMMARY OF THE INVENTION

The transformer core of the present invention is adapted to be utilized in conjunction with primary and secondary coil windings to cause a magnetic field of one coil to link to, or cause, a magnetic field in the other coil, and includes a first leg, a second leg, a first yoke and a second yoke. The first and second legs have first and second ends and are coupled to the first and second yokes to provide a magnetic flux path. This magnetic flux path greatly concentrates the magnetic field generated by the current in the primary coil, thus increasing the inductance of the primary and secondary coils.

According to one aspect of the present invention the first and second legs are made of a material having a high grain orientation, and the first and second yokes are made of a material having a lower grain orientation than the material of the first and second legs. The grain orientation of the material of the first and second legs is aligned in a direction substantially between the first end thereof to the second end thereof. This allows the legs to operate efficiently with high induction and small cross-sectional area, such that the electrical windings or coils may also be small, lowering cost and increasing the overall efficiency of the transformer. The yokes, however, can be taller to reduce induction and energy loss without impacting the size or performance of the legs and coils.

According to another aspect of the present invention, the first and second legs and the first and second yokes are comprised of a plurality of packets of laminations. In the preferred embodiment the packets of laminations of the first and second legs are positioned in a staggered manner to alternately extend beyond adjacent packets of laminations of the first and second legs, respectively, at the first end, the second end, or at alternating first and second ends thereof. A portion of the laminations of the first and second legs which extend beyond adjacent laminations of the first and second legs, respectively, at the first and second ends thereof, overlaps portions of the laminations of the first and second yokes to create a lapped joint. This lapped joint decreases the magnetic flux resistance and subsequently reduces buzz in the transformer. Additionally, the laminations for the legs and the yokes are substantially rectangular pieces having straight cutoffs, providing easy machineability, little scrap, and low cost.

According to another aspect of the present invention, the hybrid transformer has a third leg between the first and second legs, the third leg being similarly coupled to the first and second yokes. Like the first and second legs, the third leg is comprised of laminations of material having a high grain orientation. Further, the packets of laminations of the third leg are staggered to alternately extend beyond adjacent laminations of the third leg at the first and second ends thereof.

According to yet another aspect of the present invention, primary and secondary windings are coiled about the legs of the core. With the identified core, one, two and three-phase transformers can be manufactured.

Other features and advantages of the invention will be apparent from the following specification taken in conjunction with the following drawings.

DETAILED DESCRIPTION OF THE PREFERRED EMBODIMENT

Figure 1:
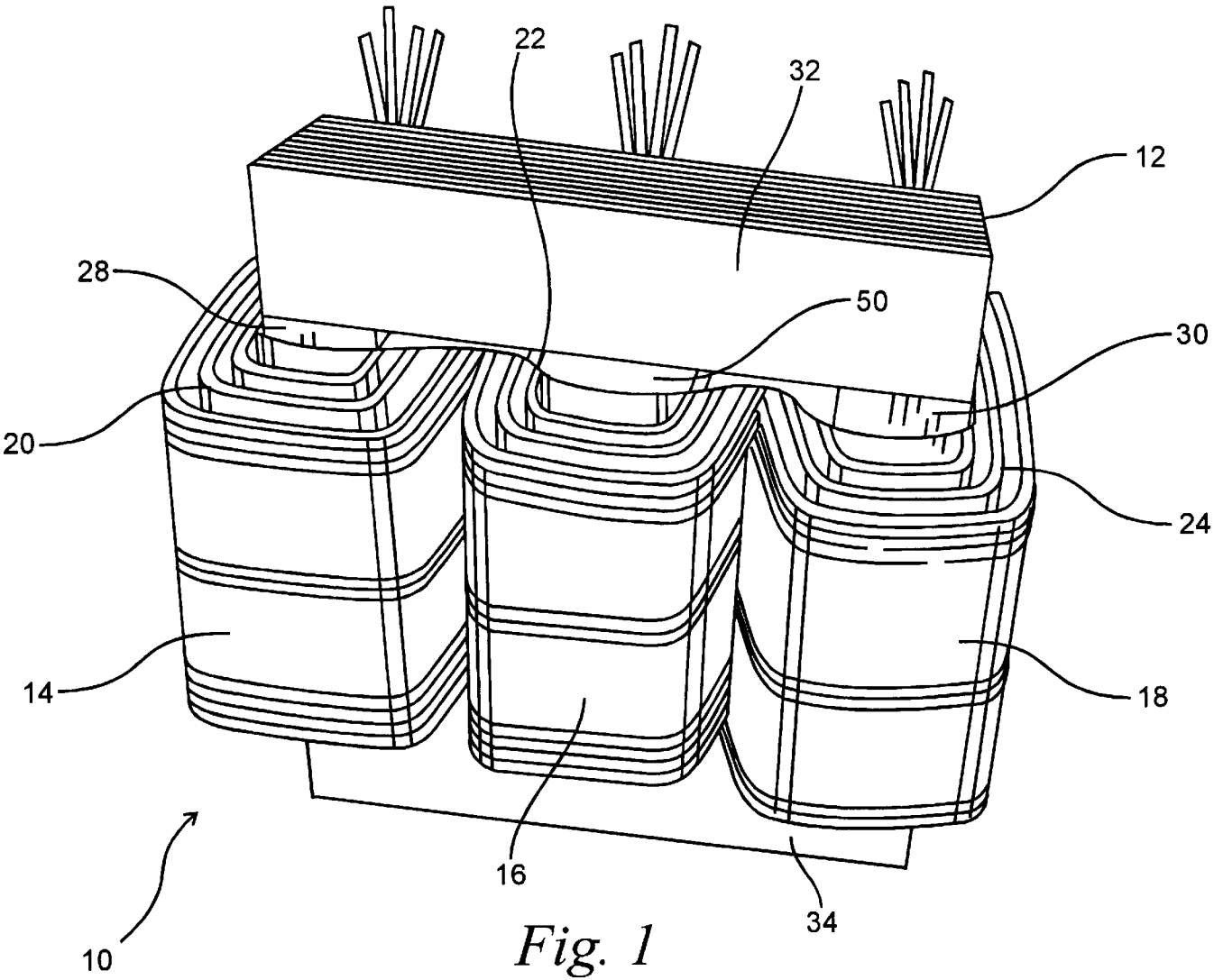
FIG. 1 is a perspective view showing a transformer with a transformer core of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now in detail to the Figures, and initially to FIG. 1, there is shown a three phase transformer 10 including a laminated magnetic core 12 with three primary coils 14,16, 18 and three secondary coils 20,22,24. The transformer 10 is manufactured in two stages: first the laminations of the magnetic core are constructed, and second, the primary and secondary coils are wound about legs of the core.

Figure 2:
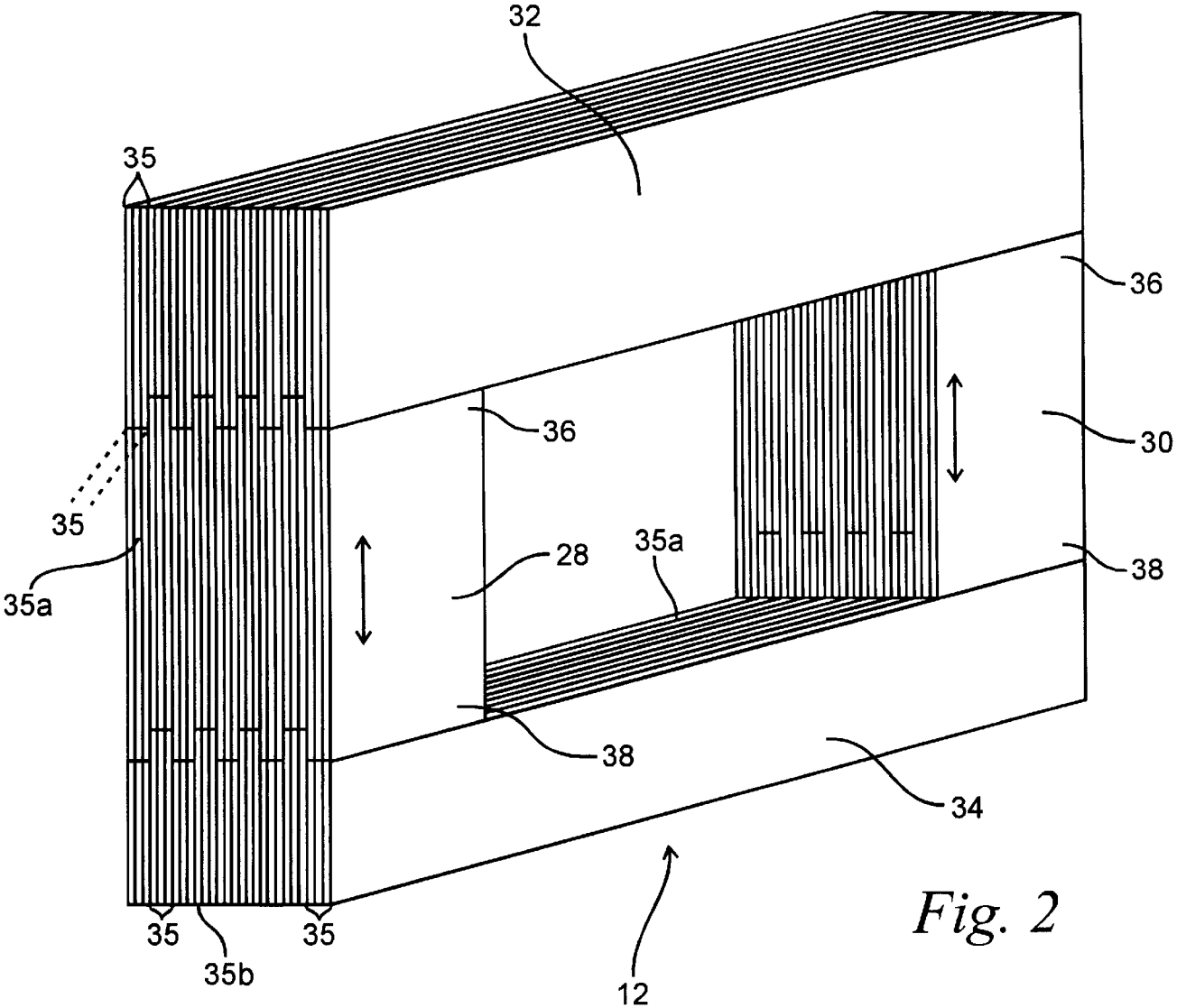
FIG. 2 is a partial perspective view showing the transformer core of the present invention.

FIG. 2 illustrates a preferred embodiment of an energy efficient transformer core 12 constructed in accordance with the present invention. The transformer core 12 is generally comprised of at least two leg members, herein a first leg member 28 and a second leg member 30, a first yoke 32 and a second yoke 34. In the preferred embodiment, the first leg 28 and the second leg 30 are each comprised of a plurality of packets 35. Each packet is formed of a plurality of laminations 35*a*. The laminations range from 7/1000" to 18/1000". Each packet is of the order of ¼" thick. Each packet 35 of the first leg and each packet 35 of the second leg has a first end 36 and a second end 38. The first end 36 of the first leg 28 and the first end 36 of the second leg 30 are substantially adjacent the first yoke 32 to couple the first and second legs 28,30 to the first yoke 32 in a magnetic flux path manner. Similarly, the second end 38 of the first leg 28 and the second end 38 of the second leg 30 are adjacent the second yoke 34 to couple the first and second legs 28,30 to the second yoke 34 in a magnetic flux path manner.

Further, each lamination 35*a* of the first leg and the second leg is made of a material having a high grain orientation. Preferably, the leg laminations 35*a* are made of high grade grain-orientated silicon steel. In the preferred embodiment this steel is non-aging and has high magnetic permeability. Additionally, this steel is treated with a moisture-resistant coating that prevents atmospheric corrosion. Magnetic steel of this type presents less reluctance to the magnetic flux in directions parallel to the favored magnetic direction than in directions transverse thereto. The grain orientation of the material of the leg laminations 35*a*, shown with an arrow in FIG. 2, is aligned in a direction substantially between the first end 36 to the second end 38 thereof (i.e., along the longitudinal direction of each leg lamination). Similarly, the grain orientation of the laminations 35*a*, shown with an arrow in FIG. 2, is aligned in a direction substantially from the first end 36 to the second end 38 thereof. Regardless of the total number of legs of the core 12, each leg will have a grain orientation aligned in substantially the same orientation, i.e., from the first end 36 to the second end 38.

Each of the packets 35 of the leg members are substantially the same length, and have substantially straight cutoffs at each side and end thereof. As shown in FIG. 2, the laminations 35*a* of the leg members are preferably manufactured in the shape of rectangles. Each leg lamination is punched, sheared, or laser cut directly from adjacent laminations. With this configuration, as opposed to having angled or mitered ends, scrap is eliminated, thereby reducing cost.

Opposing first and second yokes 32,34 are adjacent the first and second ends 36,38 of the first and second legs 28,30, respectively. Similar to the legs, the first and second yokes 32,34 are comprised of a plurality of packets 35, each formed of a plurality of yoke laminations 35*b*. The material comprising the yoke laminations 35*b*, however, has a lower grain orientation than the material of the leg laminations 35*a*. Preferably, the material comprising the yoke laminations 35*b* is non-grain orientated. Having legs 28,30 made of high grain orientated material coupled in an overlapping manner with yokes 32,34 made of lower or non-grain orientated material, instead of having yokes made of high grain orientated material, provides for reduced joint losses. Specifically, with a hybrid core the flux transferring from the leg to the yoke is not impeded by a direct transition from a high grain orientation element to another high grain orientation element which is positioned 90° thereto. Additionally, all of the laminations of the legs and yokes have substantially straight edges and ends which provide for a less expensive core.

During assembly of the overall transformer core 12, the plurality of leg laminations 35*a*, along with the plurality of yoke laminations 35*b* are layered, one lamination layer on top of another, to form the respective packets 35. FIG. 2 illustrates nine packet layers. It has been found that a core comprising twelve to twenty packet layers works well, although it can be readily seen that various other numbers of packets would suffice. The exact number of packets depends upon the desired performance characteristics of the transformer core and the type of material being used.

The packets 35 are staggered or positioned such that alternating packets extend beyond adjacent packets at alternating first and second ends 36,38 of the legs, respectively. More specifically, the packets of the first and second legs are staggered to alternately extend vertically beyond adjacent packets. Once the layers of laminations are stacked, they are securely clamped or otherwise secured together by conventional means. The thickness of the magnetic core 12 depends on the number and thickness of the packets therein. The overlap is approximately ¼" to ½.

At the location where the lamination of the legs meets the laminations of the yokes, a magnetic coupling occurs. Specifically, the first and second legs 28,30 are coupled to the first and second yokes 32,34 to create a closed core 12. More specifically, as shown in FIG. 2, the first end 36 of the first leg 28 and the first end 36 of the second leg 30 are adjacent the first yoke 32 to couple the first and second legs 28,30 to the first yoke 32, and the second end 38 of the first leg 28 and the second end 38 of the second leg 30 are adjacent the second yoke 34 to couple the first and second legs 28,30 to the second yoke 34. This magnetic coupling takes place at the overlap between the laminations of the leg and the laminations of the yokes, and between the staggered extensions of the laminations of the legs and the notches of the laminations of the yokes. With a core 12 having two legs 28,30 and two yokes 32,34 the closed core forms a continuous magnetic flux path from at least the first leg 28 to the first yoke 32, the first yoke 32 to the second leg 30, the second leg 30 to the second yoke 34, and the second yoke 34 back to the first leg 28.

The end result of the staggered legs provides for an alternating overlap between the joints of the legs and the yokes, and an overall reduction in joint losses. Specifically, in addition to the reduction in potential resistance in the magnetic flux path when transferring from the highly grain orientated legs 28,30 to the lower or non-grain orientated yokes 32,34, the overlap between the yokes and the legs further reduces the resistance (reluctance) in the magnetic flux path. The overlap between the yokes and the legs also reduces the buzz or magnetic hum associated with the flux transfer from the legs to the yokes.

A transformer assembly 10 having more than two legs, such as for a three-phase transformer, is constructed in a similar manner just discussed. As an example, with a third leg 50 as shown in FIG. 1, the third leg 50 being between the first 28 and second legs 30, the third leg 50 is similarly comprised of a plurality of packets having first 36 and second ends 38. Each packet is made of material having a high grain orientation that is aligned in a direction substantially between the first end 36 to the second end 38 thereof. Like the laminations of the first and second legs 28*a*,30*a*, the packets of the third leg 50 are staggered to alternately extend beyond adjacent packets of the third leg at the first 36 and second ends 38 thereof. This scenario would be similar for any number of additional legs.

The hybrid lamination process enhances magnetic permeability by insuring that the material grain direction in the legs is the same as the magnetic flux path. Additionally, the hybrid lamination process ensures that the magnetic flux path is not impeded by a direct grain variance between the legs and the yokes.

The transformer further includes a primary winding or coil 14,16,18 arranged around each leg member. A secondary winding or coil 20,22,24 is also arranged around each leg member and is magnetically coupled with the primary winding so that the magnetic lines of force of the primary winding intersect with the secondary winding. Other arrangements of the primary winding and secondary winding are suitable for use with the present invention. For example, the primary and secondary windings can be wound side by side or have different degrees of overlap.

While the specific embodiments have been illustrated and described, numerous modifications come to mind without significantly departing from the spirit of the invention, and the scope of protection is only limited by the scope of the accompanying claims.

We claim:

1. A transformer core comprising:

a first leg comprising a plurality of packets of laminations having a first end and a second end, the first leg being made of a material having a high grain orientation;

a second leg comprising a plurality of packets of laminations having a first end and a second end, the second leg being made of a material having a high grain orientation; and, opposing first and second yokes comprising a plurality of packets of laminations made of a material having a lower grain orientation than the material of the first and second legs, wherein the first end of the first leg and the first end of the second leg are adjacent the first yoke to couple the first and second legs to the first yoke, wherein the second end of the first leg and the second end of the second leg are adjacent the second yoke to couple the first and second legs to the second yoke, wherein the packets of laminations of the first and second legs are positioned to alternately extend beyond ends of adjacent packets of laminations of the first and second legs, respectively, to directly contact the first and second yokes, and wherein the packets of laminations of the first and second legs that alternately extend behind ends of adjacent packets of laminations of the first and second legs, respectively, also directly contact the first and second yokes.

2. The transformer core of claim 1, wherein the grain orientation of the first and second legs is aligned in a direction from the first end to the second end of each leg.

3. The transformer core of claim 1, wherein the first and second yokes are made of a non-grain orientated material.

4. The transformer core of claim 1, wherein a continuous magnetic flux path is formed extending from the first leg to the first yoke, the first yoke to the second leg, the second leg to the second yoke, and the second yoke back to the first leg.

5. The transformer core of claim 1, wherein the packets of the first and second legs are positionally staggered to alternately extend beyond ends of adjacent packets of the first and second legs, respectively, for contacting the first and second yokes.

6. The transformer core of claim 1, further comprising a primary winding about the first leg.

7. The transformer core of claim 6 further comprising a secondary winding about the first leg.

8. The transformer core of claim 1, further comprising a secondary winding about the second leg.

9. The transformer core of claim 1, wherein the first leg and the second leg are made of a high grade grain-orientated silicon steel having a high magnetic permeability.

10. The transformer core of claim 1, wherein alternating packets of laminations of the first yoke have a dimension less than adjacent packets of laminations of the first yoke, wherein alternating packets of laminations of the second yoke have a dimension less than adjacent packets of laminations of the second yoke, and wherein the alternating packets of laminations of the first and second yokes that have a dimension less than adjacent packets of laminations of the first and second yoke mate with the packets of laminations of the first and second legs that extend beyond adjacent packets of laminations of the first and second legs.

11. A transformer core assembly comprising:

a first leg comprising a plurality of laminations having first and second ends and made of a high grain-orientated material, wherein the grain orientation of the material of the laminations of the first leg is aligned in a direction from the first end to the second end thereof;

a second leg comprising a plurality of laminations having first and second ends and made of a high grain-orientated material, wherein the grain orientation of the material of the laminations of the second leg is aligned in a direction from the first end to the second end thereof; and, opposing first and second yokes comprising a plurality of laminations made of a material having a lower grain orientation than the material of the first and second legs, the first end of the first leg and the first end of the second leg being adjacent the first yoke to couple the first and second legs to the first yoke in a magnetic flux path manner, and the second end of the first leg and the second end of the second leg being adjacent the second yoke to couple the first and second legs to the second yoke in a magnetic flux path manner, wherein packets of laminations of the first leg are alternately positioned to extend beyond ends of adjacent packets of laminations of the first leg to contact the laminations of the first and second yokes at the sides of the packets, and wherein packets of laminations of the second leg are alternately positioned to extend beyond ends of adjacent packets of laminations of the second leg to contact the laminations of the first and second yokes at the sides of the packets.

12. The transformer core of claim 11, wherein the packets of laminations of the first leg are staggered to alternately extend beyond adjacent packets of laminations of the first leg at the first and second ends thereof.

13. The transformer core of claim 11, wherein the packets of laminations of the second leg are staggered to alternately extend beyond adjacent packets of laminations of the second leg at the first and second ends thereof.

14. The transformer core of claim 11, wherein a portion of the packets of laminations of the first and second legs which extend beyond ends of adjacent packets of laminations of the first and second legs, respectively, further overlaps portions of the packets of laminations of the adjacent first and second yokes, respectively.

15. The transformer core of claim 11, wherein the laminations of the first and second yokes are made of a material that is non-grain orientated.

16. The transformer core of claim 11, wherein alternating packets of laminations of the first yoke have a dimension less than adjacent packets of laminations of the first yoke, wherein alternating packets of laminations of the second yoke have a dimension less than adjacent packets of laminations of the second yoke, and wherein the alternating packets of laminations of the first and second yokes that have a dimension less than adjacent packets of laminations of the first and second yoke mate with the packets of laminations of the first and second legs that extend beyond adjacent packets of laminations of the first and second legs.

* * * * *